US008079469B2

(12) United States Patent
Gui et al.

(10) Patent No.: US 8,079,469 B2
(45) Date of Patent: Dec. 20, 2011

(54) CASE FOR HOLDING A HAND TOOL

(75) Inventors: YaoKun Gui, Shanghai (CN); Brent Christopher, Portland, OR (US); Mark Holtan, Centennial, CO (US); Anthony Kriz, Lone Tree, CO (US)

(73) Assignee: Meridian International Co., Ltd. (CN)

( * ) Notice: Subject to any disclaimer, the term of this patent is extended or adjusted under 35 U.S.C. 154(b) by 0 days.

(21) Appl. No.: 12/605,600

(22) Filed: Oct. 26, 2009

(65) Prior Publication Data

US 2011/0005954 A1 Jan. 13, 2011

(30) Foreign Application Priority Data

Jul. 7, 2009 (CN) ..... 2009 2 0077910 U

(51) Int. Cl.
*B65D 85/00* (2006.01)

(52) U.S. Cl. ..... 206/349; 206/373

(58) Field of Classification Search ..... 206/349, 206/372, 373, 374, 376, 378, 379; 16/421, 16/429; D3/274
See application file for complete search history.

(56) References Cited

U.S. PATENT DOCUMENTS 1,177,072 A * 3/1916 Warman ..... 294/57
4,682,688 A 7/1987 Budert
4,899,877 A 2/1990 Kiernan
4,924,733 A 5/1990 McKenzie
5,174,178 A 12/1992 Disston, Jr.
5,279,417 A 1/1994 Seaton
5,606,897 A 3/1997 Quinn
5,740,706 A 4/1998 Tseng
5,743,395 A * 4/1998 Backer ..... 206/378
5,816,401 A 10/1998 Vasudeva et al.
5,899,329 A 5/1999 Hu et al.
5,918,741 A 7/1999 Vasudeva
6,079,298 A 6/2000 Gasperi et al.
6,237,451 B1 5/2001 Wei
6,457,916 B2 10/2002 Wienhold
6,464,840 B1 10/2002 McCann (Continued)

OTHER PUBLICATIONS

Definition of rachet from the Merriam-Webster Online Dictionary. http://www.merriam-webster.com/dictionary/ratchet. Accessed Jul. 13, 2011.*

(Continued)

*Primary Examiner* — J. Gregory Pickett
*Assistant Examiner* — King M Chu
(74) *Attorney, Agent, or Firm* — Jason R. Sytsma; Shuttleworth & Ingersoll, PLC

(57) ABSTRACT

In accordance with one aspect of the present invention, a case for holding a hand tool at a point of sale is provided. The hand tool has a working end and a handle. The handle projects from the case to form a handle for the case and the case engages the hand tool such that the hand tool is prevented from being removed from the case while simultaneously, the handle can be rotated with respect to the case to test a function of the hand tool. Before the case and the hand tool is purchased the hand tool is prevented from being removed from the case; however, the handle can be rotated with respect to the case when the case is in a closed position. After the hand tool is purchased the customer can break a seal and the case may be opened, thereby allowing the tool to be removed from the case when the case is in an open position.

12 Claims, 3 Drawing Sheets

U.S. PATENT DOCUMENTS

| | | | | |
|---|---|---|---|---|
| 6,561,523 | B1 | 5/2003 | Wienhold | |
| 6,685,018 | B1 | 2/2004 | Chuan | |
| 2002/0020537 | A1 * | 2/2002 | Shonfeld et al. | 172/378 |
| 2002/0027092 | A1 | 3/2002 | Hu | |
| 2004/0094444 | A1 | 5/2004 | Chen | |
| 2004/0251153 | A1 | 12/2004 | Chen | |
| 2005/0189250 | A1 | 9/2005 | Hsu | |
| 2005/0247587 | A1 * | 11/2005 | Holland-Letz | 206/373 |
| 2006/0260964 | A1 * | 11/2006 | Feldmann et al. | 206/373 |
| 2007/0023307 | A1 | 2/2007 | Liu | |
| 2007/0095690 | A1 | 5/2007 | Nguy et al. | |
| 2007/0163906 | A1 * | 7/2007 | Crain et al. | 206/361 |
| 2007/0228240 | A1 | 10/2007 | Kao | |
| 2008/0110302 | A1 | 5/2008 | Liu | |
| 2009/0236250 | A1 | 9/2009 | Wang | |
| 2009/0242443 | A1 | 10/2009 | Chen | |
| 2010/0108552 | A1 | 5/2010 | Scrimshaw et al. | |

OTHER PUBLICATIONS

European search report dated Oct. 25, 2010 from counterpart European application.

Oct. 28, 2010 USPTO Office Action from related U.S. Appl. No. 12/789,158.

Apr. 18, 2011 USPTO Office Action from related U.S. Appl. No. 12/789,158.

* cited by examiner

CASE FOR HOLDING A HAND TOOL

CROSS-REFERENCE TO RELATED APPLICATIONS

The present application claims the benefit of Chinese Application 200920077910.4 filed Jul. 7, 2009, which is incorporated herein by reference.

TECHNICAL FIELD

This invention relates to a case for displaying hand tools at a point of sale, and particularly a case that allows a customer to test the hand tool without removing the hand tool from the case.

BACKGROUND INFORMATION

Tool sets are customarily sold in cases with multiple interchangeably driven bits. The cases are sealed at the point of sale to prevent the hand tool and/or the driven bits from being lost or stolen. Consequently, it is not possible for the customer to test the hand tool without opening the case and breaking the seal.

Previous disposable packages have been designed to allow the customer to test a tool while it remains in the package. Such packaging has been limited to scissor type hand tools wherein one handle is exposed and the other loop handle is enclosed in the packaging. The packaging has some room for the working end of the scissors to operate.

Heretofore, reusable cases have not been designed so a hand tool can be functionally tested while remaining in the case. Accordingly, there is a need for a case that provides for functional testing of the handle by the user, while securing the tool to the case.

SUMMARY

In accordance with one aspect of the present invention, a case for holding a hand tool at a point of sale is provided. The hand tool has a working end and a handle. The handle projects from the case to form a handle for the case and the case engages the hand tool such that the hand tool is prevented from being removed from the case, while simultaneously the handle can be rotated with respect to the case to test a function of the hand tool. Before the case and the hand tool is purchased the hand tool is prevented from being removed from the case, but the handle can be rotated with respect to the case. After the hand tool is purchased the customer can break a seal and the case may be opened, thereby allowing the tool to be removed from the case.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
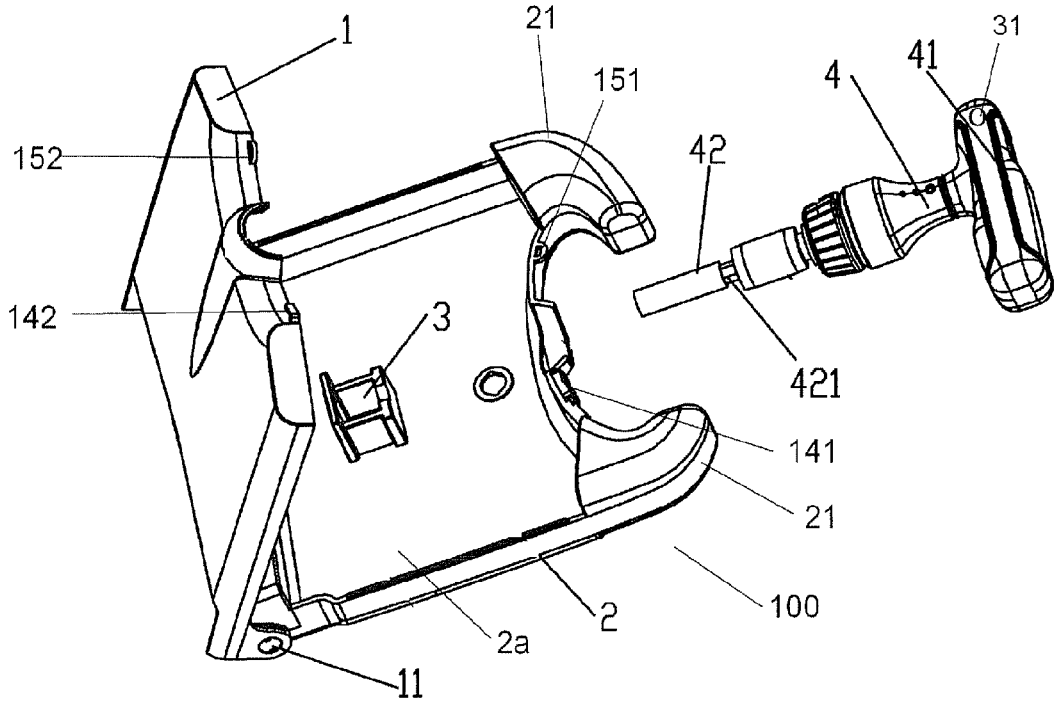
FIG. 1 is a perspective view of the front side of the tool case in the open position and the tool removed from the tool case.
Figure 2:
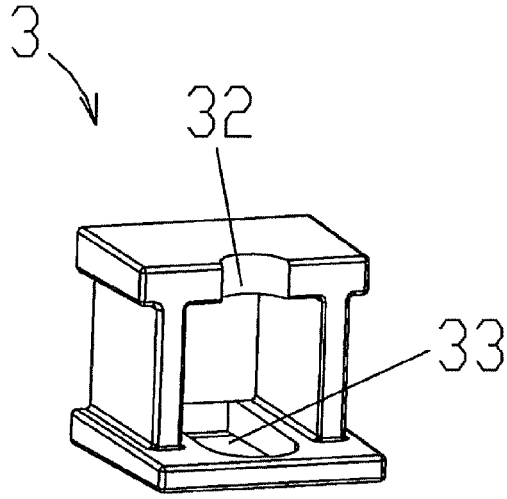
FIG. 2 is a perspective view of the retaining member of the tool case.
Figure 3:
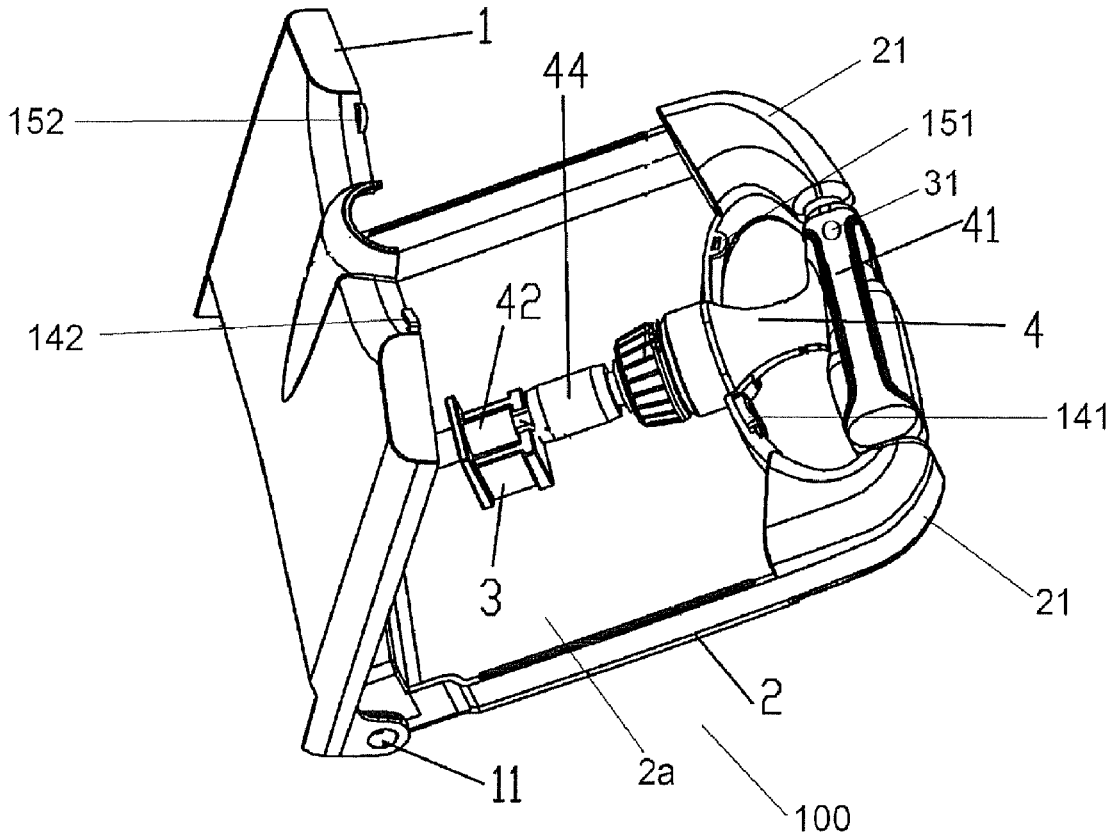
FIG. 3 is a perspective view of the front side of the tool case in the open position with the tool combined with the tool case.
Figure 4:
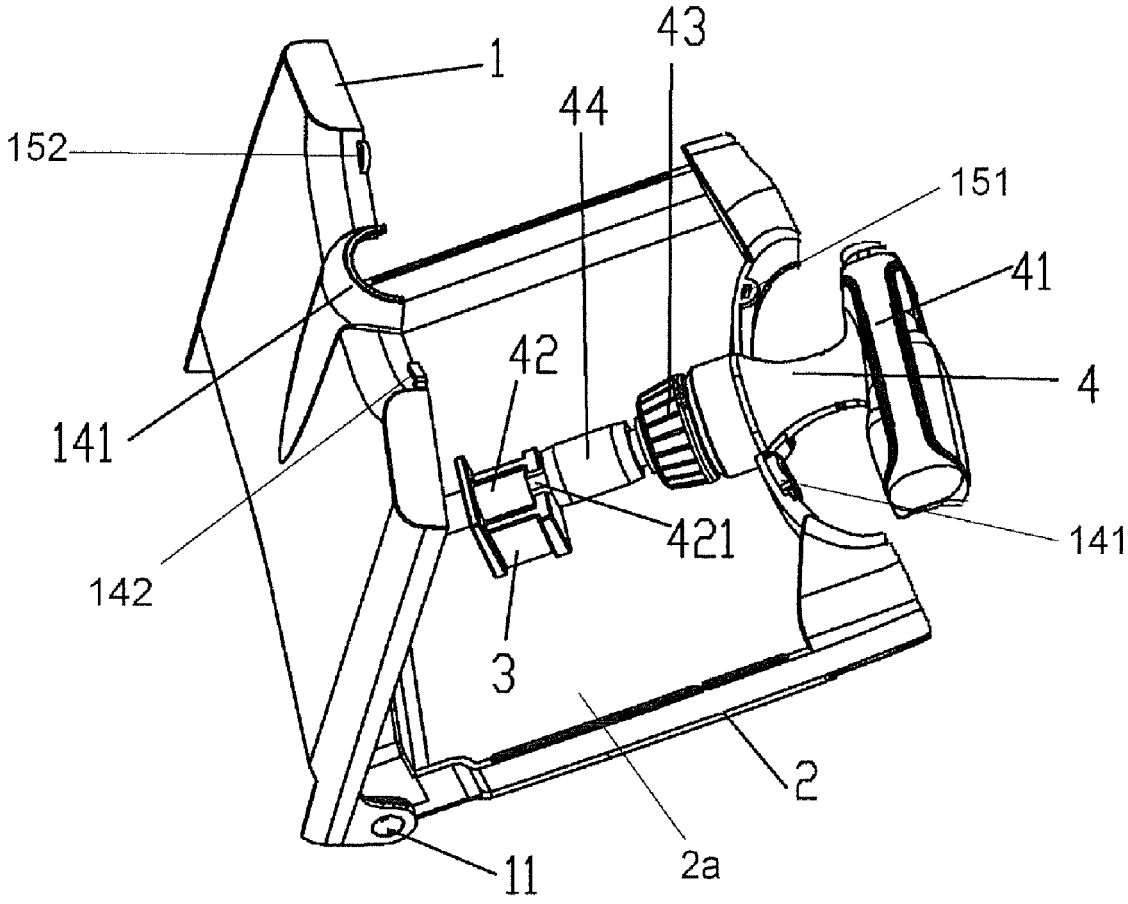
FIG. 4 is a perspective view of the front side of the tool case with the tool combined with the case of a second embodiment.

With reference to FIGS. 1-4, the hand tool 4, in accordance with an embodiment, is a ratcheting type driver 4; however, one skilled in the art would understand that the present disclosure is not so limited. The driver 4 has a working end 42 and a handle 41. The handle 41 projects from the case 100 to form a handle 41 for the case 100 and the working end 42 is attached inside the case 100 by a retaining member 3, to prevent the hand tool 4 from being removed.

The case 100 in accordance with an embodiment includes a first side 1 and a second side 2 pivotable about a pivot point 11. The case 100 is suitable for carrying a hand tool 4 and may be adapted to carry hand tool accessories (not shown). In an alternate embodiment, the case 100 does not open and the hand tool accessories are adapted to fit into receptacles on the front of the case. In yet another embodiment, the case is a disposable package for holding and displaying the hand tool 4 at a point of sale. In a further embodiment, the case 100 has a transparent first side 1, made of any suitable material, such as plastic, to allow customers to see the contents of the case.

In an embodiment, the first side 1 and second side 2 of the case 100 are selectively lockable. A sliding latch 141 on the second side 2 engages a protrusion 142 on the first side 1 to selectively hold the case 1 in a closed position. Also, the case 100 may be fixed in the closed position at the point of sale. The first side 1 and second side 2 of the case 100 have corresponding eyes 151 and 152, respectively. The eyes 151 and 152 are adapted to receive a zip-tie to hold the case 4 in the closed position.

At the point of sale, it is preferable to have one or more ways of displaying the case 100. In an embodiment, the handle 41 of the hand tool 4 has an aperture 31 having an axis perpendicular to a first side 1 of the case 100 when the opposed handle portions 21 are aligned with the handle 4. The aperture 31 allows the case 1 to be displayed on, for example a hanger on a display rack.

The retaining member 3 combines with the inside wall 2*a* of the case 100 and is adapted to receive the hand tool 4 and hold the working end 42 of the hand tool 4 in position when the case 100 is closed. In the illustrated embodiment, the retaining member 3 has a semi-circular cut-out 32 and hole 33 adapted to receive the working end 42 of the hand tool 4. The top edge 421 of the working end 42 fits underneath the bottom of edge of the semi-circular cut-out 32. When the case 100 is in the closed position, the hand tool 4 cannot be removed from the retaining member 3. When the case 100 is opened, the hand tool 4 is readily removable from the retaining member 3.

In an embodiment, the case 100 has two opposed projecting handle portions 21. The projecting handle portions 21 form part of the handle for the case 100. When the hand tool 4 is combined with the case 100, the opposed handle portions 21 and the handle 41 of the hand tool 4 form a generally continuous handle for the case 100. In an alternative embodiment, shown in FIG. 4, the projecting handle portions 21 have been removed and the handle 41 of the hand tool 4 is the sole handle for the case. In both embodiments, the handle 41 of the hand tool 4 projects from the case and is rotatable with respect to the case 100. The aforementioned designs advantageously allow the customer to test the function of the hand tool 4 by rotating its handle 41 with respect to the case 100.

In an embodiment, the handle 41 of the hand tool 4 is generally T-shaped and has an ergonomic feel to comfortably form to a customer's hand. However, any shape or variation of the handle 41 may be provided, so long as it provides a comfortable grip for the customer.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

We claim:

1. A case for holding and displaying a hand tool at a point of sale, the case comprising:

two covers that pivot with respect to each other between an open and closed position; and two opposed handle portions positioned on opposite sides of the case and projecting upward from the case a sufficient distance above an upper mating edge of the covers to create an opening for a user to wrap the user's fingers around at least one of the opposed handle portions and the fingers are positioned above the upper mating edge of the covers, and a generally T-shaped hand tool is positioned within the case, a projecting portion of a handle of the hand tool fits together with the two opposed handle portions to form a generally continuous handle for the case, wherein the handle can be rotated by the user to test a selective one-way rotational ratcheting function of the hand tool while simultaneously, the hand tool is prevented from being removed from the case.

2. The case of claim 1, wherein the tool handle has an aperture having an axis perpendicular to a display side of the case when the two opposed handle portions and the handle are in alignment.

3. The case of claim 1, wherein the hand tool is prevented from being removed from the case and the handle can be rotated with respect to the case when the case is in a closed position.

4. The case of claim 1, wherein the hand tool is allowed to be removed from the case when the case is in the open position.

5. The case of claim 1, wherein a pair of opening are formed between a lower edge of the generally continuous handle and the upper mating edge of the covers in the closed position, the openings being divisible by the handle for the hand tool, wherein the case is adapted to be carried by the handle for the hand tool and the user's fingers are adapted to curve around the handle for the hand tool and pass through the openings.

6. The case of claim 5, wherein the generally continuous handle has an arcuate profile.

7. The case of claim 6, wherein the handle portions each have a fixed face that projects upward from the cover in an arcuate path towards and facing each other.

8. The case of claim 7, wherein the handle is a generally T-shaped handle having a longitudinal portion perpendicular to a working end, the longitudinal portion having opposing faces at distal ends, the opposing faces of the longitudinal portion, when the hand tool is positioned in the case, face the respective fixed faces of the handle portions and are separated by a minimal distance sufficient to form the generally continuous handle while simultaneously, allowing the function of the hand tool to be tested.

9. The case of the claim 8, wherein the generally continuous handle forms a substantially continuous arc between the respective sides of the case.

10. The case of claim 3, and further comprising a pair of mating eyes adapted to receive a locking mechanism for holding the covers in the closed position at the point of sale.

11. A case for holding and displaying a hand tool at a point of sale, the case comprising:

two covers that pivot with respect to each other between an open and closed position, in the closed position the two covers have an upper mating edge adjacent to each other and external to the case on a side of the case opposite of a pivoting axis for the two covers; and two opposed handle portions positioned on opposite sides of the case and, in the closed position, the two opposed handle portions projecting upward from the upper mating edge of the two covers a sufficient distance to create an opening for a user to wrap the user's fingers around at least one of the opposed handle portions and the fingers are positioned above the upper mating edge of the covers, and a generally T-shaped hand tool is positioned within the case, a projecting portion of a handle of the hand tool fits together with the two opposed handle portions to form a generally continuous handle for the case above the upper mating edge of the two covers, wherein the handle can be rotated by the user to test a function of the hand tool while simultaneously, the hand tool is prevented from being removed from the case.

12. An apparatus comprising:

a case having a front side and a back side that come together to form an upper mating edge outside the case that has a first opening to the inside of the case, a retaining portion, and two opposed handle portions positioned on opposite sides of the case and projecting upward from the upper mating edge a sufficient distance to create a second opening between the opposed handle portions and the upper mating edge for a user to wrap the user's fingers around at least one of the opposed handle portions with the fingers positioned above the upper mating edge;

a hand tool having a working end and a generally T-shaped handle spaced apart from the working end, the generally T-shaped handle having a longitudinal portion perpendicular to the working end and sufficiently long to receive a palm of a user's hand, and the case engages the hand tool such that the generally T-shaped handle projects out of the first opening in the upper mating edge of the case with the longitudinal portion positioned a sufficient distance above the upper mating edge for fingers of the user's hand to wrap around the longitudinal portion and remain outside the case;

wherein the generally T-shaped handle for the hand tool fits together with the two opposed handle portions to form a generally continuous handle for the case above the upper mating edge; and wherein the hand tool is prevented from being removed from the case by the retaining portion while simultaneously, the generally T-shaped handle can be rotated by the user with respect to the case to test a rotational ratcheting function of the hand tool.

* * * * *